United States Patent [19]

Hancock

[11] 4,159,826

[45] Jul. 3, 1979

[54] PNEUMATIC JOGGING PLATFORM

[76] Inventor: John J. Hancock, 4820 W. Slauson Ave., #12, Los Angeles, Calif. 90056

[21] Appl. No.: 826,257

[22] Filed: Aug. 19, 1977

[51] Int. Cl.[2] ..... A63B 5/00

[52] U.S. Cl. ..... 272/65; 182/139; 272/70

[58] Field of Search ..... 272/70, 65, 1 B, 1 E, 272/1 R, 101, 109, 130, 134, 135, 136, 66; 182/139; 5/365, 368, 370, 371; 297/DIG. 3; 9/1.3, 2 A, 11 A, 310 F

[56] References Cited

U.S. PATENT DOCUMENTS

| | | | |
|---|---|---|---|
| 1,456,168 | 5/1923 | Witmer et al. | 9/11 A |
| 2,216,871 | 10/1940 | Banks et al. | 9/11 A |
| 2,761,155 | 9/1956 | Headley | 272/1 B X |
| 3,095,947 | 7/1963 | Beaulaurier | 182/139 |
| 3,130,816 | 4/1964 | Wright | 182/139 X |
| 3,490,085 | 1/1970 | Lewis | 9/2A |
| 3,734,496 | 5/1973 | Rubin | 272/65 |
| 3,871,042 | 3/1975 | Farmer | 9/1.3 |

FOREIGN PATENT DOCUMENTS

| | | | |
|---|---|---|---|
| 2333672 | 1/1975 | Fed. Rep. of Germany | 272/65 |

*Primary Examiner*—Richard C. Pinkham
*Assistant Examiner*—Arnold W. Kramer

[57] ABSTRACT

My pneumatically sustained, flexible exercise surface-and-platform, which I call a "Trampol-air," initially designed for foot-ease along with all the benefits of exercising in any jogging-like manner on a flexing-resilient mini-trampoline-like surface, consists of a flat, flexible exercise surface supported by pneumatic tubing located underneath the outer edge (and, optionally, beneath the surface across the center area) of the exercise surface. The surface consists of a sheet of woven polypropoline (or other suitable material) which covers the pneumatic tubing and fastens at the back of the exercise platform's base (which extends out several inches beyond the exercise surface). The base may be made of a sturdy substance, such as one-inch thick plywood, or of thinner metal with a one-inch upward-curving circular lip around the edge. On the underneath-area of the base there is an access hole (or doors) large enough for putting air into the pneumatic tubing.

4 Claims, 4 Drawing Figures

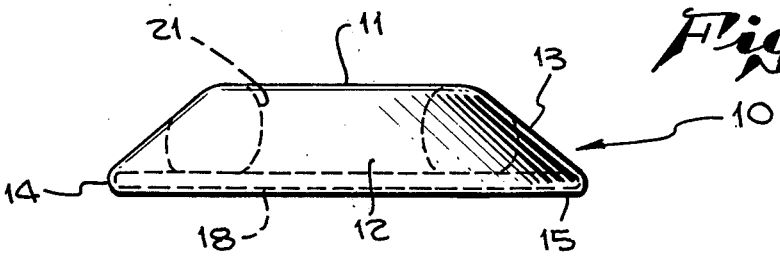
Fig. 1.
Fig. 2.
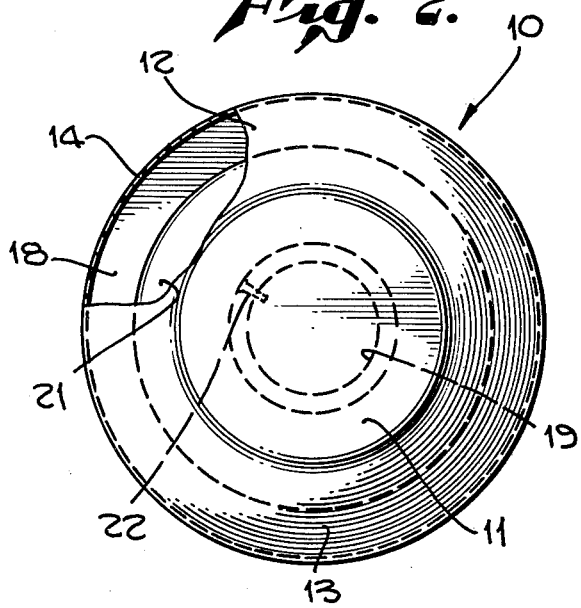
Fig. 3.
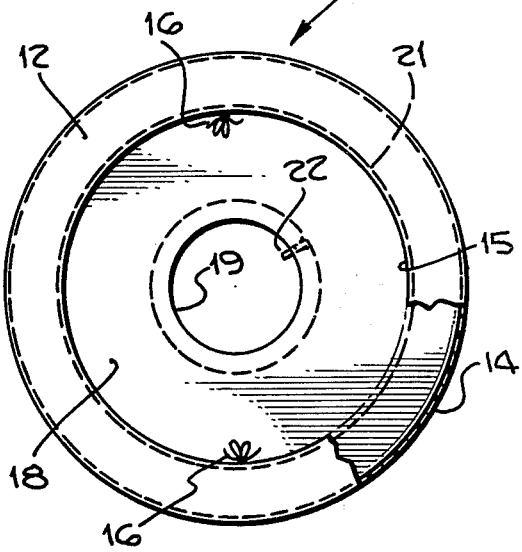
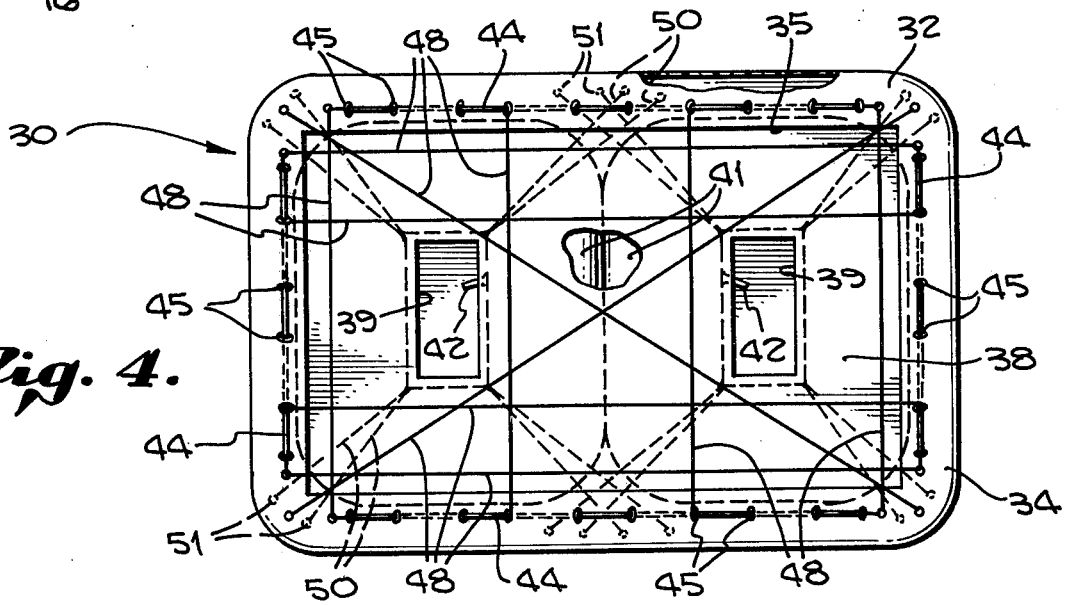
Fig. 4.

PNEUMATIC JOGGING PLATFORM

DETAILED DESCRIPTION OF THE DRAWINGS:

FIG. 1 is a side elevation of the invention.

FIG. 2 shows a top view drawing of the device.

FIG. 3 shows a bottom view partly broken away.

FIG. 4 is a bottom view of a second embodiment form of the Trampol-air (trampoline-like invention). This is to illustrate how the invention may be constructed in a variety of shapes and sizes.

The scale of the drawings is that of two millimeters representing one inch. The Circular Model, represented by FIGS. 1, 2, and 3, is forty inches in diameter, across the base. (My "Trampol-air" may be constructed in any desired, proportionate or near proportionate size). The Rectangular Model, represented by FIG. 4, is forty inches wide and sixty inches long, at the base.

FIG. 1 shows the device in mode of use described generally as Number 10 and may be considered the preferred form of my invention.

Number 11, is the "jogging surface" or exercise area. It is approximately 21 to 24 inches in diameter on the Circular Model shown in FIGS. 1, 2, and 3, and is approximately 21 to 24 inches wide and about 40 inches long on the Rectangular Model shown in FIG. 4.

The exercise surface, 11, is part of the entire "surface-covering", 12, which on the Circular Model is made of a circular piece of woven polypropolene 56 inches in diameter with cinch-ropes, 16, within a two-inch hem, 15, around the circumference. Surface 11 is planar and then slopes down angled surface.

Item 12 is the surface-covering where it slopes down to curve under the one-inch think lip of the base and on under the base a few inches to be cinched tightly with cinch-ropes, 16. The cinch-cords, 16, are located within a two-inch hem around the edge of the polypropolene surface-covering. (Item 13 also is a reference to the surface-covering where it slopes down at an angle to curve under the one-inch thick lip of the base and on under the base a few inches to be cinched tightly with cinch-ropes, 16.)

Item 21, FIG. 1, represents a cross-sectional view of the inflated tube. (The tube in this instance is a 16-inch truck tire tube.) This model shown uses just one circular tube, 21, in FIG. 2, 3 and 1. (Numbers 14, FIGS. 1, 2 and 3, follow):

Numbers 14, FIGS. 1, 2 and 3, are the exterior one-inch thick, bevelled edges (or upward-turned one-inch-in-diameter metalic semicircular lip) of the base, 18, FIGS. 1, 2 and 3, (whether the base is made of one-inch-thick plywood, as in this example, or of metal or of some other intractible substance).

Items 19, FIGS. 2 and 3, represent the opening in the base (18, FIG. 3), for access to the air-stem of the tube; number 22 indicates this air valve stem.

FIG. 4 represents the rectangular model of the same invention described above. FIG. 4 is a bottom view. It is represented by the general number 30. The surface covering, which forms the exercise surface, is made of a 56 by 84 inch piece of woven polypropolene, 32, with metal rods, 44, threaded through a two-inch hem on each side and each end to facilitate cinching the polypropolene underneath the rim, 34, of the base, 38.,. The polypropolene covering-surface is cinched in place before the air is inserted in the tubing, 41, thus assuring a very tight exercise surface. The cinch-ropes, 48, extend between the metal rods, 44, which run through buttonhole-like eyelets (or grommets), 45, in the hem, 35, of the polypropolene, 32 and 34, at opposite sides and ends.

FIG. 4 shows in dotted line outline two (normally circular) tubes, 41, side-by-side, held in rather rectangular position by ropes which are represented in the drawings by dotted lines, 50, from tie-holes, 51, at the four corners and from the middle of the sides of the base, 38.

Number 39 indicates the access openings in the base for putting air into the valve stems, 42, of the tubes. (A taping or lacing of non-elastic collars around the tubes where they pass under the center of the rectangular model are advisedly used to hold the tubes at correct inflation size so as to prevent unwanted bulging in that area.)

I claim:

1. A pneumatically sustained trampoline jogging apparatus comprising a flat rigid base having a peripheral edge; a continuous flexible covering stretching horizontally above said base, downwardly (at outward angle) beyond said peripheral edge and back under said base; means cinching the margin of said covering under said base; pneumatic tubing means positioned between the top surface of the base and the covering inwardly of said peripheral edge; and inflation valve means in said tubing means whereby on inflation of said pneumatic tubing means said flexible covering forms a pneumatically sustained surface of a trampoline jogging apparatus.

2. A jogging apparatus as in claim 1, wherein the contour of said peripheral edge of said base is circular and said pneumatic tubing means is a tire tube.

3. A jogging apparatus as in claim 1 wherein the contour of said peripheral edge of said base is substantially rectangular and said pneumatic tubing means consists of a pair of tire tubes (collared against excessive bulge in the central area), laid side-by-side.

4. A jogging apparatus as in claim 1 wherein said side-by-side tubes are held in rectangular position by ropes extending through the openings in the center of the tubes and extending to tie-holes at the four corners and to the middle of the sides of said base.

* * * * *